US010083648B2

(12) United States Patent
Feng

(10) Patent No.: US 10,083,648 B2
(45) Date of Patent: Sep. 25, 2018

(54) IMAGE DISPLAY METHOD AND DISPLAY APPARATUS

(71) Applicant: EVERDISPLAY OPTRONICS (SHANGHAI) LIMITED, Shanghai (CN)

(72) Inventor: Yu-Hsiung Feng, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 57 days.

(21) Appl. No.: 15/081,543

(22) Filed: Mar. 25, 2016

(65) Prior Publication Data

US 2016/0314735 A1 Oct. 27, 2016

(30) Foreign Application Priority Data

Mar. 27, 2015 (CN) ..... 2015 1 0142031

(51) Int. Cl.
*G09G 3/20* (2006.01)
*G09G 3/3266* (2016.01)
(Continued)

(52) U.S. Cl.
CPC ..... *G09G 3/2074* (2013.01); *G09G 3/2003* (2013.01); *G09G 3/3266* (2013.01);
(Continued)

(58) Field of Classification Search
CPC .. G09G 3/2074; G09G 3/2003; G09G 3/3275; G09G 3/3266; G09G 2300/0452;
(Continued)

(56) References Cited

U.S. PATENT DOCUMENTS

2002/0140655 A1 10/2002 Liang
2010/0096988 A1* 4/2010 Kitabayashi ..... H01L 27/326 315/51
2013/0293526 A1 11/2013 Igawa
2015/0029208 A1 1/2015 Kim
(Continued)

FOREIGN PATENT DOCUMENTS

CN 101727828 A 6/2010
CN 103745684 A 4/2014
CN 103927946 A 7/2014
CN 104201192 A 12/2014
CN 104319283 A 1/2015
CN 104332486 A 2/2015
(Continued)

OTHER PUBLICATIONS

The 1st office action issued in the counterpart CN application No. 201510142031.5 dated Feb. 27, 2018, by the SIPO.
(Continued)

*Primary Examiner* — Md Saiful A Siddiqui
(74) *Attorney, Agent, or Firm* — Yunling Ren

(57) ABSTRACT

The present disclosure discloses an image display method and a display apparatus. The display apparatus includes a pixel array which is composed of a plurality of basic pixel units repeated along horizontal and vertical directions; the pixel array includes first sub-pixels of a first color, second sub-pixels of a second color and third sub-pixels of a third color; wherein, the display method includes: acquiring first data denoting positions and gray values needed to be displayed of each color in the image respectively; acquiring second data denoting space proportions of each color occupied in each pixel of the pixel array respectively; and for each of the sub-pixels contained in each of the pixels, acquiring third data according to the first data and the second data to display the image, the third data denoting a display gray value of each of the sub-pixels of the pixels in the pixel array.

16 Claims, 21 Drawing Sheets

(51) Int. Cl.
*G09G 3/3275* (2016.01)
*G09G 3/3208* (2016.01)

(52) U.S. Cl.
CPC ..... *G09G 3/3275* (2013.01); *G09G 3/3208* (2013.01); *G09G 2300/0452* (2013.01); *G09G 2310/027* (2013.01); *G09G 2320/0242* (2013.01); *G09G 2320/0666* (2013.01); *G09G 2340/0407* (2013.01); *G09G 2340/0457* (2013.01); *G09G 2360/16* (2013.01)

(58) Field of Classification Search
CPC ..... G09G 2310/027; G09G 3/3208; G09G 2320/0242; G09G 2320/0666; G09G 2340/0407; G09G 2340/0457
See application file for complete search history.

(56) References Cited

U.S. PATENT DOCUMENTS

| | | | | |
|---|---|---|---|---|
| 2015/0130868 | A1 | 5/2015 | Feng | |
| 2016/0300519 | A1* | 10/2016 | Shi ..... | G09G 3/2003 |

FOREIGN PATENT DOCUMENTS

| | | | |
|---|---|---|---|
| CN | 104347668 | A | 2/2015 |
| GB | 2320790 | A | 7/1998 |

OTHER PUBLICATIONS

The Extended European Search Report issued by the EPO, dated Jul. 26, 2016.

* cited by examiner

IMAGE DISPLAY METHOD AND DISPLAY APPARATUS

CROSS-REFERENCE TO RELATED APPLICATIONS

The present application is based upon and claims priority to Chinese Patent Application No. 201510142031.5, filed Mar. 27, 2015, the entire contents of which are incorporated herein by reference.

TECHNICAL FIELD

The present disclosure relates to the field of display technology, and more particularly, to an image display method and a display apparatus.

BACKGROUND

The active matrix organic light emitting diode (hereinafter referred to as AMOLED) is used in a new generation of display apparatuses. The pixel unit of traditional pixel array consists of three sub-pixels of red, green and blue. However, the pixel array design of the current AMOLED tends to reduce the number of sub-pixels. Therefore, an individual pixel (also referred to as a pixel point or pixel unit) of the pixel array no longer consists of three sub-pixels of red, green and blue.

The pixel array shown in FIG. 1 is a pixel array in Delta arrangement, whose line cycle is 2, and column cycle is 3. The pixel of the pixel array may be composed in different manners such as red, green; red, blue; or green, blue; and the like.

As well known, only three primary colors may compose all colors, but two colors cannot compose all colors. So, when displaying an image actually, one pixel will "borrow" another color from its adjacent pixel to compose the three primary colors, i.e., it needs pixel compensation to display the image.

The pixel compensation algorithm used in the existing display method of the display apparatus is a "method of borrowing light from the adjacent pixel". That is, in horizontal and/or vertical directions, each pixel unit and the adjacent pixel unit share the sub-pixel of the color that they do not own themselves, to achieve an effect of white-displaying collectively. The specific steps of the "method of borrowing light from the adjacent pixel" are as follows.

In the following introduction, R' is an actual gray value of a certain pixel in a picture to be displayed, R" is a gray value that should be displayed by the corresponding pixel in the Delta pixel array, and R is a gray value displayed finally in the Delta pixel array.

Taking a pixel Pixel (2,2) in FIG. 1 as an example, the pixel only includes two kinds of sub-pixels G and B, the missing red color R' (2,2) may be displayed by red color R (2,1) in the adjacent left pixel and 0.5 $R_{Real}$ of red color R (2,3) in the adjacent right pixel.

$$R''(2,2)=R'(2,1)+\tfrac{1}{2}R'(2,3)$$

Because the area of R is 1.5 times of the area of R', the gray value of R may be reduced by 1.5 times when acquiring the same display effect.

$$R'(2,1)=\left[R'(2,1)+\frac{1}{2}R'(2,2)\right]\times\frac{2}{3}=\frac{2}{3}R'(2,1)+\frac{1}{3}R'(2,2)$$

-continued $$R(2,3)=\frac{2}{3}R'(2,3)+\frac{1}{3}R'(2,2)$$

However, using the display method of prior art based on the above compensation algorithm, the obtained image quality is shown in FIGS. 2-5. As can be seen, there are technical problems such as blurred image edges, poor saturability and so on in the above display method of the prior art.

Besides, using the display method of prior art based on the above compensation algorithm, it cannot distinguish and deal with different situations where the display apparatus is applied, for example, an application mainly displayed in words and an application mainly displayed in images, thus cannot obtain satisfactory display effects.

SUMMARY

Directing at problems existing in the prior art, the present disclosure aims to provide an image display method.

Another aim of the present disclosure is to provide a display apparatus.

The above invention aims of the present disclosure are realized by the following technical solutions.

According to an aspect of the disclosure, there is provided an image display method, for presenting an image on a display apparatus; the display apparatus includes a pixel array which is composed of a plurality of basic pixel units repeated along horizontal and vertical directions, and the pixel array has sub-pixels located within pixel spaces of at least two different pixels; the pixel array includes first sub-pixels of a first color, second sub-pixels of a second color and third sub-pixels of a third color;

wherein, the display method includes the following steps:

acquiring first data denoting positions and gray values needed to be displayed of each of the first, second and third colors in the image respectively;

acquiring second data denoting space proportions of each of the first, second and third colors occupied in each pixel of the pixel array respectively; and for each of the sub-pixels contained in each of the pixels, acquiring third data according to the first data and the second data to display the image, the third data denoting a display gray value of each of the sub-pixels of the pixels in the pixel array.

In the image display method of the present disclosure, optionally, the first color, second color and third color are red, blue, green respectively.

In the image display method of the present disclosure, optionally, the pixel array is arranged in delta pixel arrangement.

In the image display method of the present disclosure, optionally, each of the basic pixel units includes six pixels in two lines and three columns, and has four sub-pixel columns.

In the image display method of the present disclosure, optionally, each of the basic pixel units includes: a first pixel, a second pixel and a third pixel arranged from left to right in a first line, and a fourth pixel, a fifth pixel and a sixth pixel arranged from left to right in a second line; wherein, the second pixel to the fifth pixel are composed of sub-pixels with different colors located in two adjacent horizontal lines respectively, the first pixel and the sixth pixel are composed of sub-pixels with different colors located in the same column but separated by one horizontal line respectively.

In the image display method of the present disclosure, optionally, the second data is a proportion matrix; for each of the basic pixel units, the step of determining the second data corresponding to each of the basic pixel units is to determine a proportion vector for each pixel of the basic pixel unit firstly, and to determine the proportion matrix according to the proportion vector.

In the image display method of the present disclosure, optionally, the proportion vector of the pixel has three components denoting proportion coefficients of the first sub-pixel, second sub-pixel and third sub-pixel in the pixel respectively, and the method further includes: taking the component in the same position of each of the proportion vectors to acquire the proportion matrix.

In the image display method of the present disclosure, optionally, after acquiring the proportion matrix, the method further includes: for each sub-pixel in the basic pixel unit, multiplying the gray value needed to be displayed of the pixel to which the sub-pixel belongs by the corresponding matrix element value in the proportion matrix respectively, to obtain the display gray value of the sub-pixel in the pixel array.

In the image display method of the present disclosure, optionally, if a sub-pixel of a color of the first, second and third colors is entirely located within the pixel space of one pixel, then the proportion coefficient of the sub-pixel of the color in the pixel is set to be 1; if a sub-pixel of the color is completely not located within the pixel space of the pixel, then the proportion coefficient of the sub-pixel of the color in the pixel is set to be 0.

In the image display method of the present disclosure, optionally, if most part of a sub-pixel of the color is located within the pixel space of the pixel, then the proportion coefficient of the sub-pixel of the color in the pixel is a first proportion coefficient larger than 0.5; if a small part of a sub-pixel of the color is located within the pixel space of the pixel, then the proportion coefficient of the sub-pixel of the color in the pixel is a second proportion coefficient smaller than 0.5; a sum of the first proportion coefficient and the second proportion coefficient is 1.

In the image display method of the present disclosure, optionally, the first proportion coefficient is set to be 0.7.

In the image display method of the present disclosure, optionally, if a sub-pixel of a color of the first, second and third colors is partially located within the pixel space of one pixel, then the proportion coefficient of the sub-pixel of the color in the pixel is set to be 0.5.

According to another aspect of the disclosure, there is also provided a display apparatus, the display apparatus including:

a substrate, having a pixel region and a non-pixel region, wherein, a pixel array of the pixel region is composed of a plurality of basic pixel units repeated along horizontal and vertical directions, and the pixel array has sub-pixels located within pixel spaces of at least two different pixels; the pixel array includes first sub-pixels of a first color, second sub-pixels of a second color and third sub-pixels of a third color;

an organic light emitting diode, located in the pixel region of the substrate and including a first electrode, an organic layer and a second electrode; and a driver, electrically connected to the organic light emitting diode for driving the organic light emitting diode, the driver including:

an input unit, configured to receive an image signal to denote an image to be displayed on the display apparatus;

a sub-pixel color rendering unit, configured to acquire first data denoting positions and gray values needed to be displayed of each of the first, second and third colors in the image received by the input unit, respectively; and to acquire second data denoting space proportions of each of the first, second and third colors occupied in each pixel of the pixel array respectively; for each of the sub-pixels contained in each of the pixels, the sub-pixel color rendering unit is configured to acquire third data according to the first data and the second data, the third data denoting a display gray value of each of the sub-pixels of the pixel in the pixel array; and an output unit, configured to generate a plurality of signals according to the third data, which denote the display gray value of each of the sub-pixels of the pixel in the pixel array, and output the plurality of signals to the display apparatus.

In the display apparatus of embodiments of the present disclosure, optionally, the first color, second color and third color are red, blue and green respectively.

In the display apparatus of embodiments of the present disclosure, optionally, the pixel array is arranged in delta pixel arrangement.

In the display apparatus of embodiments of the present disclosure, optionally, each of the basic pixel units includes six pixels in two lines and three columns, and has four sub-pixel columns.

In the display apparatus of embodiments of the present disclosure, optionally, each of the basic pixel units includes: a first pixel, a second pixel and a third pixel arranged from left to right in a first line, and a fourth pixel, a fifth pixel and a sixth pixel arranged from left to right in a second line; wherein, the second pixel to the fifth pixel are composed of sub-pixels with different colors located in two adjacent horizontal lines respectively, the first pixel and the sixth pixel are composed of sub-pixels with different colors located in the same column but separated by one horizontal line respectively.

In the display apparatus of embodiments of the present disclosure, optionally, the second data is a proportion matrix; for each of the basic pixel units, when determining the second data corresponding to the basic pixel unit, a proportion vector is determined for each pixel of the basic pixel unit firstly, and the proportion matrix is determined according to the proportion vector.

In the display apparatus of embodiments of the present disclosure, optionally, the proportion vector of the pixel has three components denoting proportion coefficients of the first sub-pixel, second sub-pixel and third sub-pixel in the pixel respectively, and the proportion matrix is acquired by taking the component in the same position of each of the proportion vectors.

In the display apparatus of embodiments of the present disclosure, optionally, after the proportion matrix is acquired, for each sub-pixel in the basic pixel unit, the gray value needed to be displayed of the pixel to which the sub-pixel belongs is multiplied by the corresponding matrix element value in the proportion matrix respectively, to obtain the display gray value of the sub-pixel in the pixel array.

In the display apparatus of embodiments of the present disclosure, optionally, if a sub-pixel of a color of the first, second and third colors is entirely located within the pixel space of one pixel, then the proportion coefficient of the sub-pixel of the color in the pixel is set to be 1; if a sub-pixel of the color is completely not located within the pixel space of the pixel, then the proportion coefficient of the sub-pixel of the color in the pixel is set to be 0.

In the display apparatus of embodiments of the present disclosure, optionally, if most part of a sub-pixel of the color is located within the pixel space of the pixel, then the proportion coefficient of the sub-pixel of the color in the pixel is a first proportion coefficient larger than 0.5; if a small part of a sub-pixel of the color is located within the pixel space of the pixel, then the proportion coefficient of the sub-pixel of the color in the pixel is a second proportion coefficient smaller than 0.5; a sum of the first proportion coefficient and the second proportion coefficient is 1.

In the display apparatus of embodiments of the present disclosure, optionally, the first proportion coefficient is set to be 0.7.

In the display apparatus of embodiments of the present disclosure, optionally, if a sub-pixel of a color is partially located within the pixel space of one pixel, then the proportion coefficient of the sub-pixel of the color in the pixel is set to be 0.5.

The advantageous effects of the present invention lie in: the display apparatus of the present invention can save sub-pixels and also overcome the defects of blurred image edges and poor saturability existing in the pixel array of the prior art. Besides, the image display method of the present invention can be applied to distinguish and deal with different situations displayed by the display apparatus, for example, the application mainly displayed in words and the application mainly displayed in images, thus obtaining satisfactory display effects.

DESCRIPTION OF THE EMBODIMENTS

Typical embodiments embodying the features and advantages of the present invention will be illustrated in detail in the following description. It should be understood that the present invention may have various variations in different embodiments, none of which depart from the scope of the present disclosure, and that the description and figures therein are intended to be illustrative essentially, rather than limiting the present disclosure.

A display method (or referred to as a presenting method) of embodiments of the present disclosure can be used in a display apparatus of embodiments of the present disclosure. The display apparatus of embodiments of the present disclosure is optionally a display apparatus of a mobile phone, and more preferably, is an AMOLED display apparatus used in the mobile phone.

Figure 1:
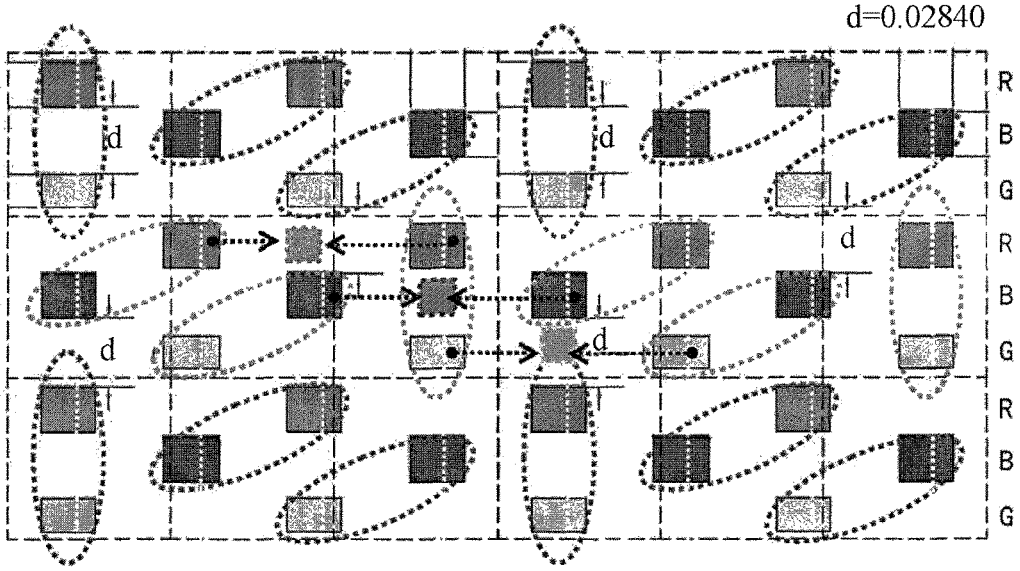
Fig. 1 (Prior Art)
FIG. 1 is a schematic diagram of the method of borrowing light from adjacent pixels of the prior art.
Figure 2:
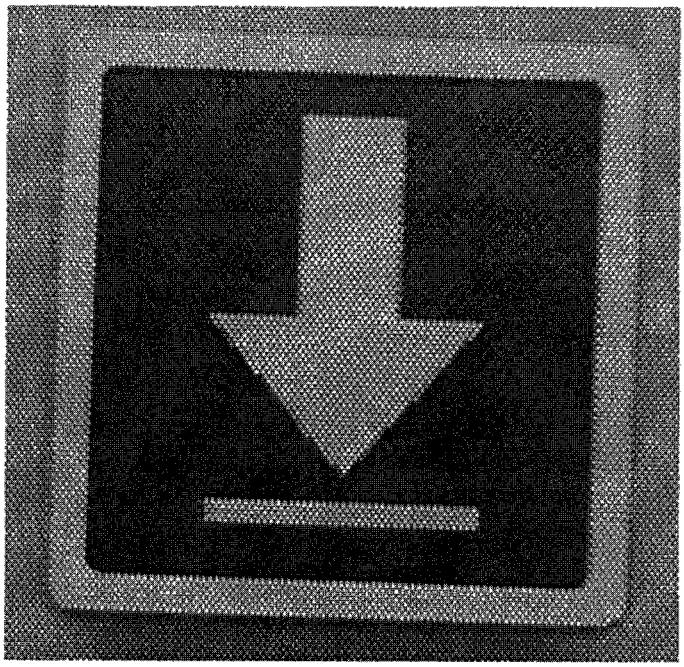
Fig. 2 (Prior Art)
FIG. 2 is a display effect diagram of displaying an arrow according to the method of borrowing light from adjacent pixels of the prior art.
Figure 3:
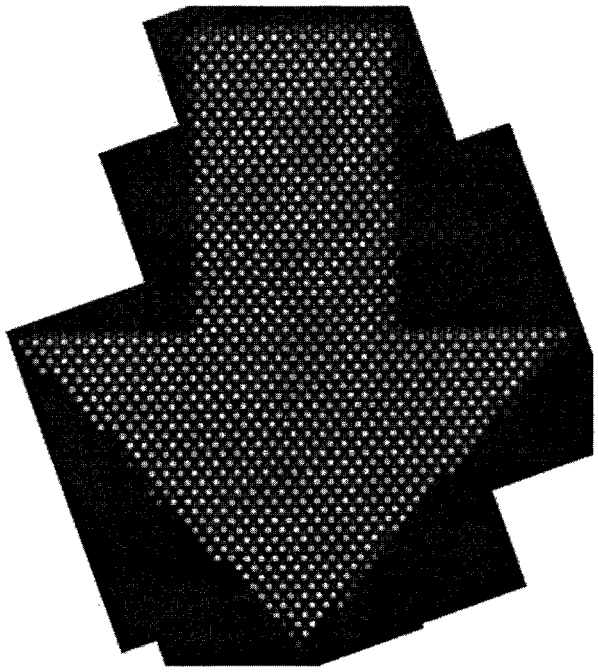
Fig. 3 (Prior Art)
FIG. 3 is a pixel effect schematic diagram of displaying an arrow according to the method of borrowing light from adjacent pixels of the prior art.
Figure 4:
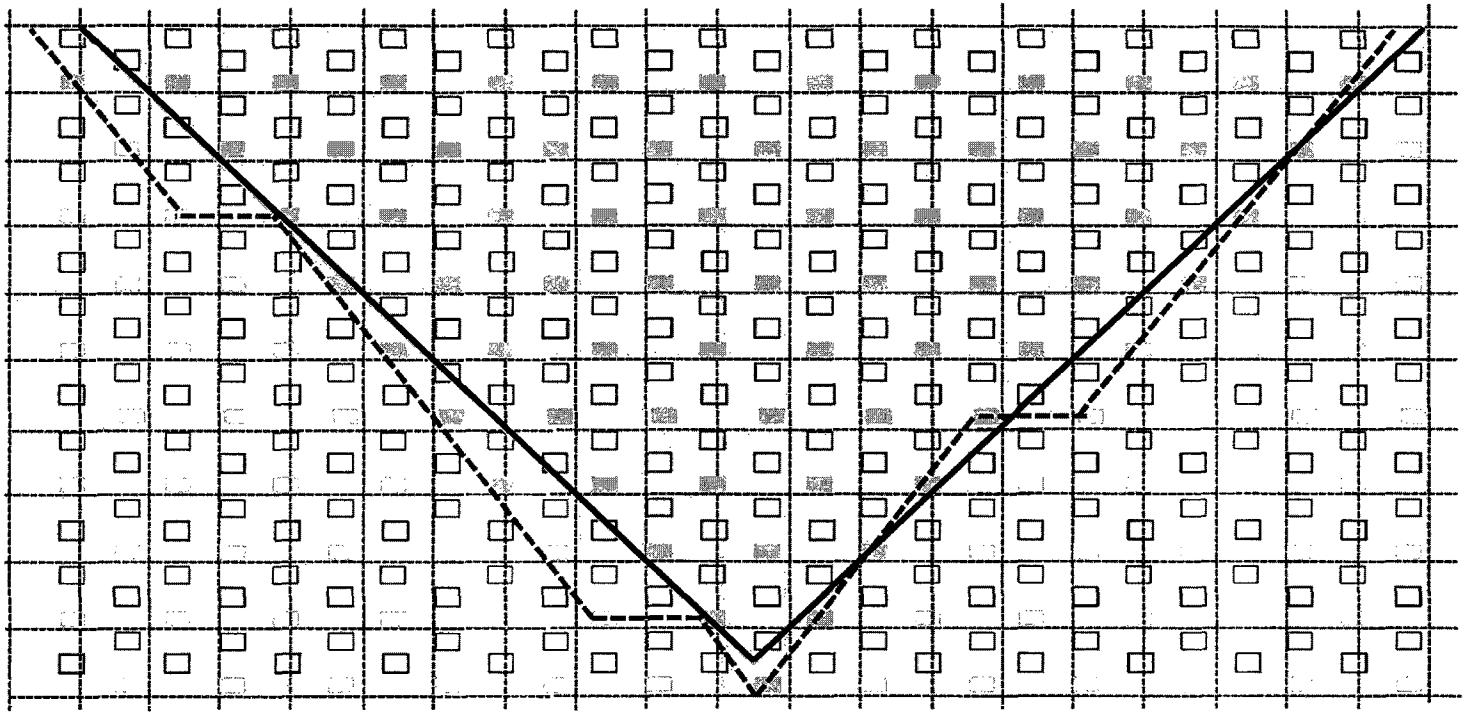
Fig. 4 (Prior Art)
FIG. 4 is a pixel schematic diagram of displaying an arrow according to the method of borrowing light from adjacent pixels of the prior art.
Figure 5:
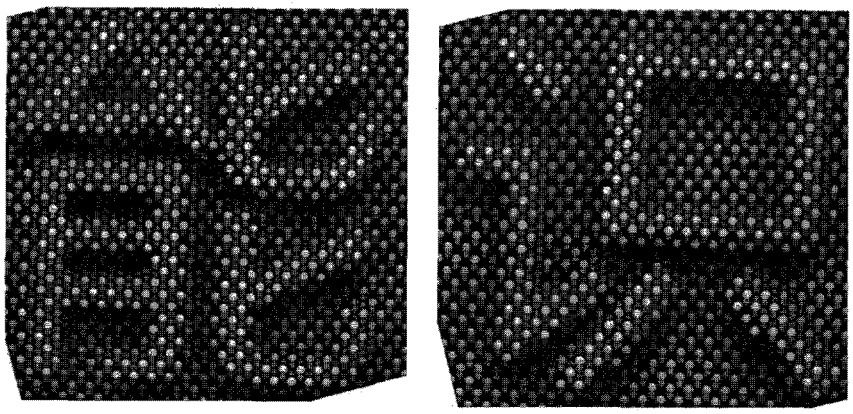
Fig. 5 (Prior Art)
FIG. 5 is a display effect diagram of displaying a word according to the method of borrowing light from adjacent pixels of the prior art.
Figure 6:
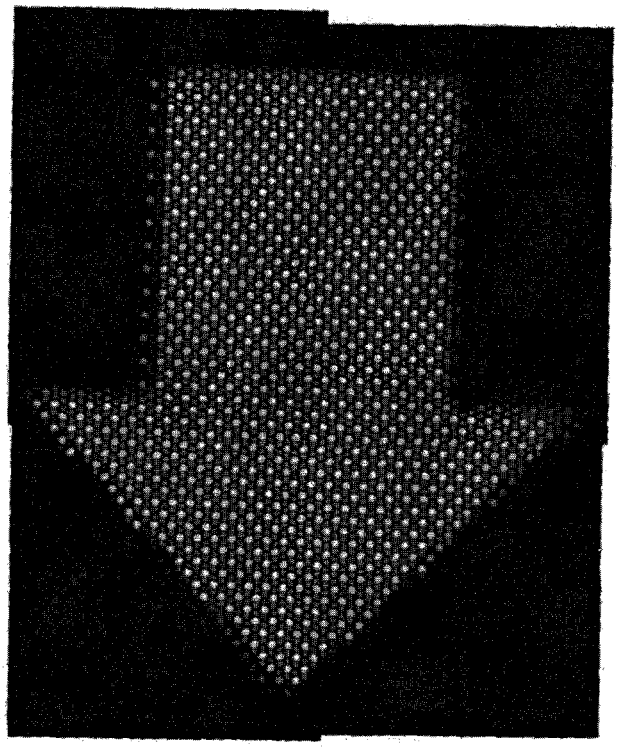
Fig. 6 (Prior Art)
FIG. 6 is a pixel effect diagram of displaying a white arrow according to the method of borrowing light from adjacent pixels of the prior art.
Figure 7:
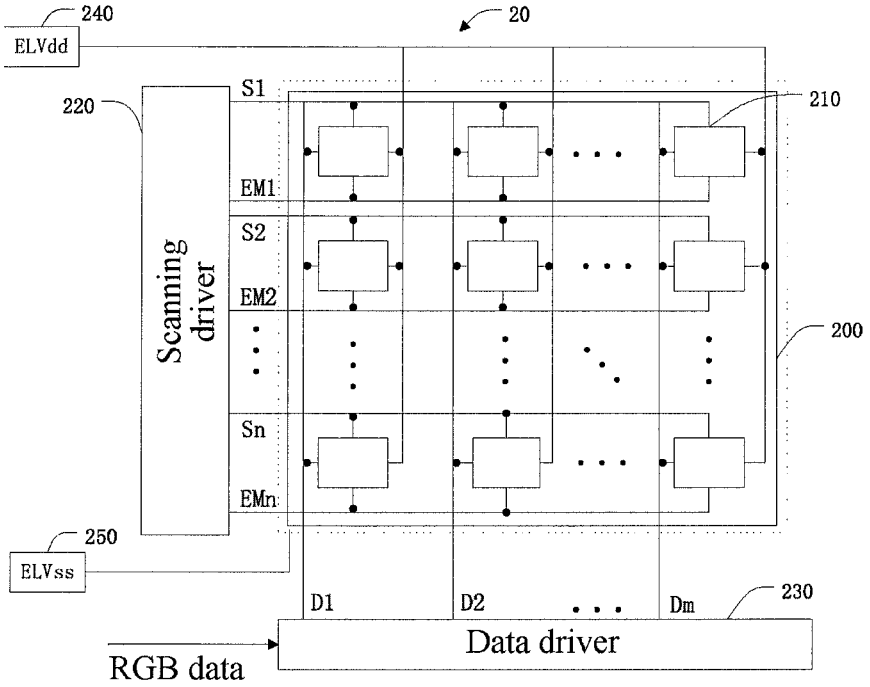
FIG. 7 is a schematic diagram of a display apparatus of embodiments of the present disclosure.

FIG. 7 is a schematic diagram of the display device of the present disclosure. The display device is an OLED display device 20. Referring to FIG. 7, the OLED display device 20 at least includes a display unit 200, a scanning driver 220 and a data driver 230. The OLED display device 20 may also include other devices and/or elements.

The display unit 200 may include a plurality of pixel points 210 connected to scanning lines (S1 to Sn), emission control lines (EM1 to EMn) and data lines (D1 to Dm). Moreover, one pixel point 210 may have one OLED, and may consist of two sub-pixels which emit light of different colors, e.g., red, green; red, blue; or green, blue.

The display unit 200 may display an image, so as to correspond to an external first power source (ELVdd) and an external second power source (ELVss). The display unit 200 may also display images corresponding to scanning signals provided through the scanning lines S1 to Sn and generated by the scanning driver 220, emission control signals provided through the emission control lines EM1 to EMn and generated by the scanning driver 220, and data signals provided through the data lines D1 to Dm and generated by the data driver 230.

The scanning driver 220 may generate the scanning signals and the emission control signals. The scanning signals generated in the scanning driver 220 may be provided to the scanning lines (S1 to Sn) sequentially, and the emission control signals generated in the scanning driver 220 may be provided to each one of the emission control lines (EM1 to EMn) sequentially. The scanning signals and the emission control signals may also be respectively provided to the scanning lines S1 to Sn and the emission control lines EM1 to EMn non-sequentially. In others embodiments, the emission control signals may also be generated by an emission control driver.

The data driver 230 may receive an input signal, e.g., RGB data, and generate a data signal corresponding to the received input signal. The data signals generated in the data driver 230 may be provided to the pixel points 210 through the data lines (D1 to Dm), to be synchronized with the scanning signals. The data signals may also be provided to the data lines D1 to Dm in a manner non-synchronized with the scanning signals.

Further, a scanning driver provides signals to each of the sub-pixel lines with the same color in the pixel array, and a data driver provides signals to each of the sub-pixel columns with different colors in the pixel array.

Figure 8:
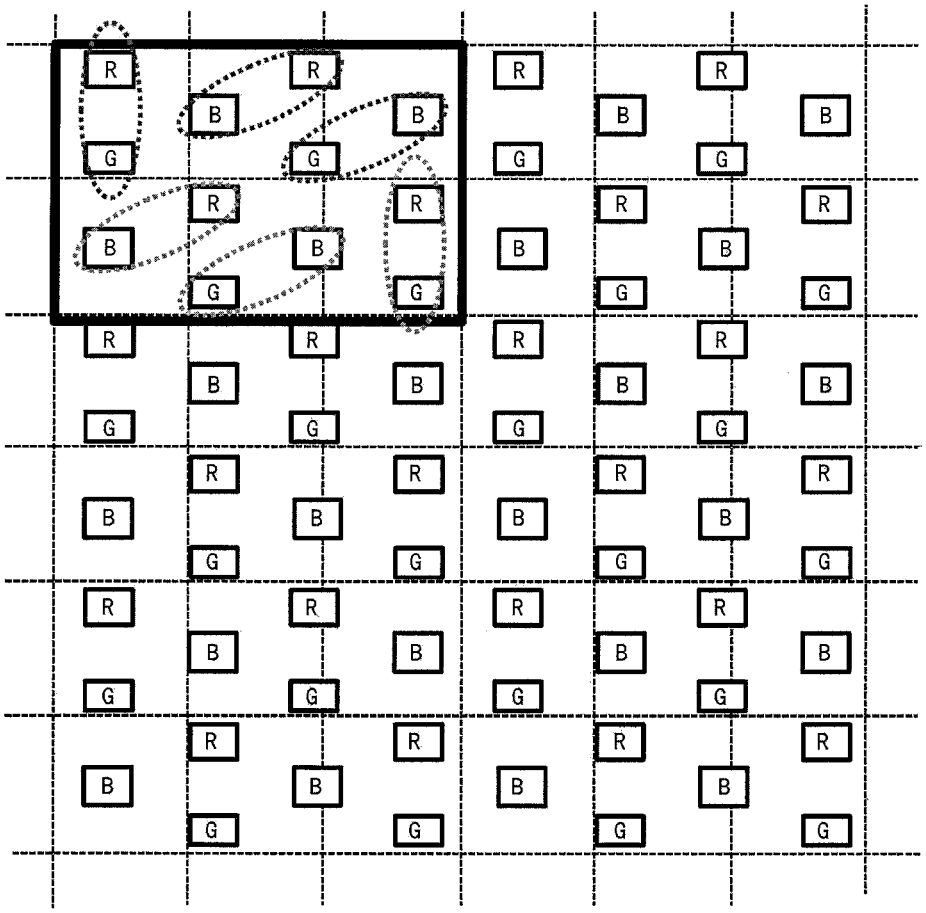
FIG. 8 is a schematic diagram of a pixel array of a display apparatus of embodiments of the present disclosure.
Figure 9:
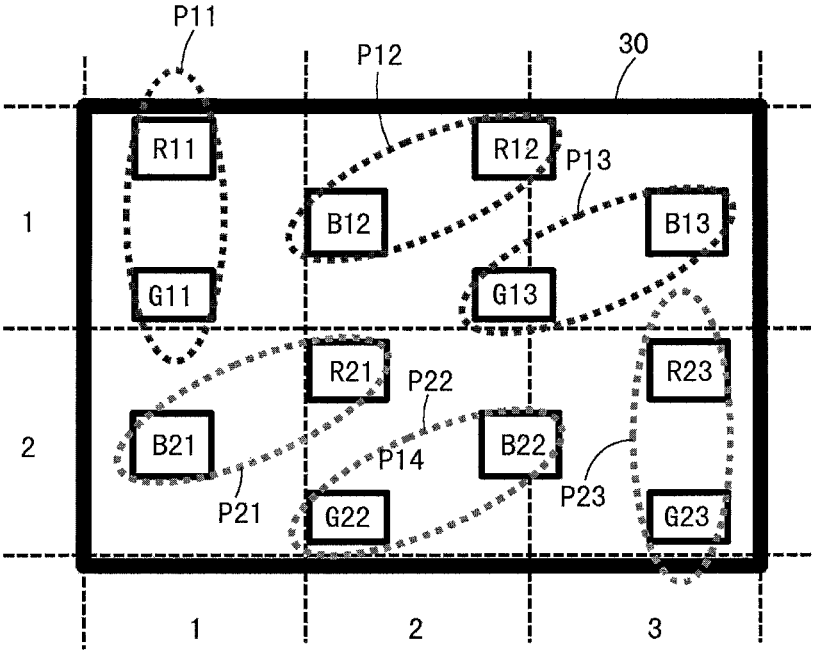
FIG. 9 is a schematic diagram of a basic pixel unit of the pixel array as shown in FIG. 8.

Next, the pixel array as shown in FIG. 8 is taken as an example to introduce the image display method of two embodiments of the present disclosure. FIG. 9 is a basic pixel unit 30 of the pixel array as shown in FIG. 8. In the pixel array as shown in FIG. 8, the pixel array is a delta distribution pixel array with a line cycle of 2 and a column cycle of 3. However, the image display method of the present disclosure is not limited to be applied to the pixel array of delta arrangement, but may also be applied to the pixel array of other pixel arrangements.

In FIG. 8, sub-pixels in the first line are all red sub-pixels R, sub-pixels in the second line are all blue sub-pixels B, sub-pixels in the third line are all green sub-pixels G, and the following arrangements of sub-pixels circulate in this order. Further, the display apparatus and display method of the present disclosure are not limited to the above pixel arrangement, and sub-pixels in the first line may also be green sub-pixels or blue sub-pixels.

In the pixel array shown in FIG. 9, one pixel 210 is essentially presented by two sub-pixels. The two sub-pixels constituting one pixel 210 have been marked by the ellipse dashed box in FIG. 9.

The pixel array shown in FIG. 8 is composed of a plurality of basic pixel units 30 in FIG. 9 repeated along horizontal and vertical directions. Each basic pixel unit 30 includes six pixels arranged in two lines and three columns: a first pixel P11, a second pixel P12 and a third pixel P13 arranged from left to right in a first line, and a fourth pixel P21, a fifth pixel P22 and a sixth pixel P23 arranged from left to right in a second line. Wherein, the second pixel P12 to the fifth pixel P22 are composed of sub-pixels with different colors located in two adjacent horizontal lines respectively, while the first pixel P11 and the sixth pixel P23 are composed of sub-pixels with different colors located in the same column but separated by one horizontal line respectively. It can be seen from FIG. 9 that, in the pixel matrix basic unit 30, the red sub-pixel R12, the green sub-pixel G13 and the blue sub-pixel B22 are located in pixel spaces of two different pixels.

As shown in FIG. 9, two sub-pixels of the first pixel P11 and the blue sub-pixel B21 of the fourth pixel P21 compose the first column in sequence from top to bottom according to a first interval in the vertical direction.

The blue sub-pixel B12 of the second pixel P12, the red sub-pixel R21 of the fourth pixel P21 and the green sub-pixel G22 of the fifth pixel P22 compose the second column in sequence from top to bottom according to the first interval in the vertical direction. The second column and the first column are separated by a second interval in the horizontal direction. As shown in FIG. 9, there are totally four sub-pixel columns in the basic pixel unit 30.

More specifically, the first interval may be less than the height of one sub-pixel, and the second interval may be greater than or equal to zero, so that color mixing will not appear between two sub-pixels composing the same pixel point.

Since only three primary colors can compose all colors, whereas two colors cannot compose all colors, so when displaying an image actually, one pixel will "borrow" another color from other pixel to compose the three primary colors, so as to achieve an effect of white displaying collectively. The display method of embodiments of the present disclosure determines a display gray value of a color in a pixel matrix by calculating the proportion of each color occupied in the shown pixel, and the position and gray value of the color in the original image.

First Embodiment

In this embodiment, the data denoting the positions and gray values needed to be displayed of each color in the image to be displayed are firstly acquired. For example, as for the red color, the gray values needed to be displayed in pixels P11-P23 are R' 11, R'12, R' 13, R'21, R'22, R'23.

Then the proportion vectors that the proportion occupied by the sub-pixels of each color in each pixel are acquired. Each proportion vector has three components, denoting the proportion coefficients of red sub-pixels, green sub-pixels, and blue sub-pixels in the pixel respectively.

The "proportion" herein refers to the proportion occupied in the space. Therefore, the compensation algorithm used in embodiments of the present disclosure may be called "occupied space algorithm". However, it should be noted that the display method of embodiments of the present disclosure does not need to calculate the proportion coefficient of sub-pixel in the pixel space accurately, but just checks whether there is sub-pixel of the color within the pixel space of the pixel. If a sub-pixel of the color is entirely located within the pixel space (a concept of area, rather than volume) of the pixel, then the proportion coefficient is set to be "1". If the sub-pixel of the color is entirely not located within the pixel space of the pixel, then the proportion coefficient is set to be "0". If the sub-pixel of the color is partly located within the pixel space of the pixel, then the proportion coefficient is set to be "0.5", no matter a larger part or a smaller part of the sub-pixel is located within the pixel space of the pixel.

Based on the above description, each proportion vectors of six pixels P11, P12, P13, P21, P22, P23 of the basic pixel unit 30 as shown in FIG. 9 are respectively:

$$P11(1,1,0),P12(0.5,0.5,1),P13(0.5,0.5,1)$$

$$P21(0,0,1),P22(1,1,0.5),P23(1,1,0.5)$$

The components in the same position of each proportion vector are taken respectively to acquire a proportion matrix. The proportion matrix denotes data representing the space proportion of each color occupied in each pixel of the pixel array.

Hence, the proportion matrixes are respectively:

$$R=\begin{bmatrix}1 & 0.5 & 0.5\\ 0 & 1 & 1\end{bmatrix}\quad G=\begin{bmatrix}1 & 0.5 & 0.5\\ 0 & 1 & 1\end{bmatrix}\quad B=\begin{bmatrix}1 & 1 & 1\\ 1 & 0.5 & 0.5\end{bmatrix}$$

After acquiring the proportion matrix, for each sub-pixel in the basic pixel unit 30, it is to multiply the gray value needed to be displayed of the pixel to which the sub-pixel belongs by the corresponding matrix element value in the proportion matrix respectively to obtain the display gray value of the sub-pixel in the pixel array. Specifically:

$$R11=R'11;R12=0.5R'12+0.5R'13$$

$$R21=R'22;R23=R'23$$

$$G11=G'11;G13=0.5G'12+0.5G'13$$

$$G22=G'22;G23=G'23$$

$$B12=B'12;B13=B'13$$

$$B21=B'21;B22=0.5B'22+0.5B'23$$

In the above formulas, R is the position and gray value of red color in the pixel array, R' is the position and gray value of red color in the original image; G is the position and gray value of green color in the pixel array, G' is the position and gray value of green color in the original image; B is the position and gray value of blue color in the pixel array, B' is the position and gray value of blue color in the original image.

Second Embodiment

The similarities between the present embodiment and the above embodiment will not be repeated herein.

The difference between the present embodiment and the above embodiment lies in that: the display method of the present embodiment does not need to calculate the pixel space percentage of the pixel accurately, but just checks whether there is sub-pixel of the color within the pixel space of the pixel. If a sub-pixel of the color is entirely located within the pixel space (a concept of area, rather than volume) of the pixel, then the proportion coefficient is set to be "1". If the sub-pixel of the color is entirely not located within the pixel space of the pixel, then the proportion coefficient is set to be "0". If the sub-pixel of the color is partly located within the pixel space of the pixel, then it needs to check whether its larger part or smaller part is located within the pixel space of the pixel; if a larger part of sub-pixel of the color is located within pixel space of the pixel, then the proportion coefficient is larger than "0.5" and may be set to be "0.7"; if a smaller part of sub-pixel of the color is located within pixel space of the pixel, then the proportion coefficient is smaller than "0.5" and may be set to be "0.3". Anyway, the sum of the proportion coefficients in both cases is also 1.

Based on the above description, in the present embodiment, as for the six pixels of the basic pixel unit 30 as shown in FIG. 9, the proportion vectors representing the proportion occupied by red, green, blue sub-pixel in each pixel respectively are:

$$P11(1,1,0),P12(0.7,0.7,1),P13(0.3,0.3,1)$$

$$P21(0,0,1),P22(1,1,0.7),P23(1,1,0.3)$$

So, proportion matrixes acquired based on the proportion vectors are:

$$R=\begin{bmatrix}1 & 0.7 & 0.3\\ 0 & 1 & 1\end{bmatrix}\quad G=\begin{bmatrix}1 & 0.7 & 0.3\\ 0 & 1 & 1\end{bmatrix}\quad B=\begin{bmatrix}0 & 1 & 1\\ 1 & 0.7 & 0.3\end{bmatrix}$$

According to the display method of the present embodiment, the display gray values of each sub-pixel in the pixel matrix are determined as:

$$R11=R'11;R12=0.7R'12+0.3R'13$$

$$R21=R'22;R23=R'23$$

$$G11=G'11;G13=0.7G'12+0.3G'13$$

$$G22=G'22;G23=G'23$$

$$B12=B'12;B13=B'13$$

$$B21=B'21;B22=0.7B'22+0.3B'23$$

It can be seen from the above two embodiments that, in a same pixel space, the maximum proportion of the sub-pixel in the same color is 1, and the minimum proportion thereof is 0; while the proportion sum of sub-pixels in different colors is 2.

The display methods of the two embodiments of the present disclosure will be described hereinafter.

Next, for the display methods of the two embodiments of the present disclosure, the display situations of several specific images are further introduced.

Figure 10:
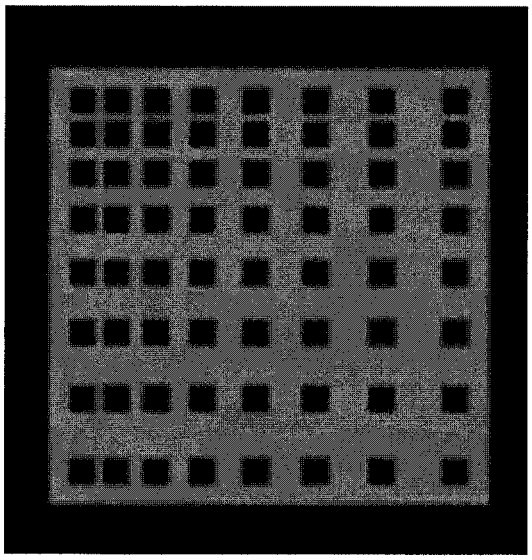
FIG. 10 is a display effect diagram of displaying an image according to the display method of the second embodiment of the present disclosure.

Firstly, take the display method of the second embodiment to display the image shown in FIG. 10 as an example to make introduction. As for the image in FIG. 10, width of the border lines is three pixels; widths of the internal horizontal lines are respectively 1-7 pixels which are increased by degrees; widths of the internal longitudinal lines also are respectively 1-7 pixels which are increased by degrees. In consideration of the image area, FIGS. 11-13 only take a part of the pixel effect diagram of the image as shown in FIG. 10. As shown in FIG. 13, one sub-pixel column with low gray level cannot be displayed. The image of FIG. 10 is displayed in red color, but the present disclosure is not limited to this. The present disclosure has the same effect when displaying in blue or green color. Therefore, red color is just taken as an example to make illustration herein.

Figure 11:
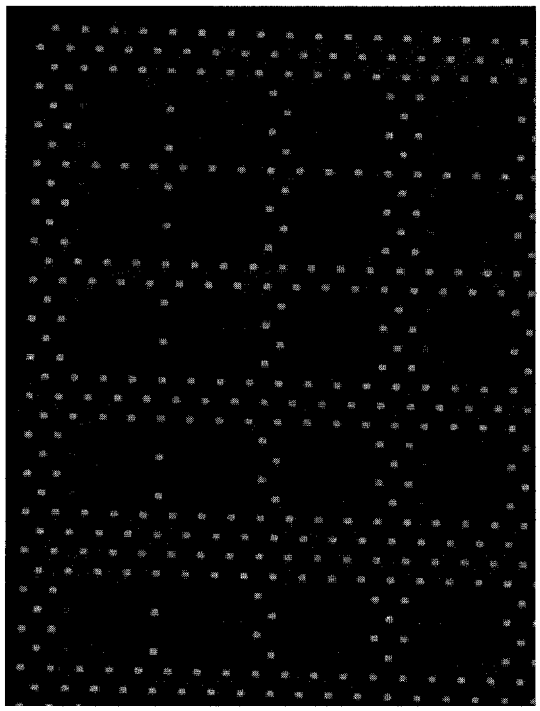
FIG. 11 is a local first pixel effect diagram of displaying the image of FIG. 10 according to the display method of the second embodiment of the present disclosure.
Figure 12:
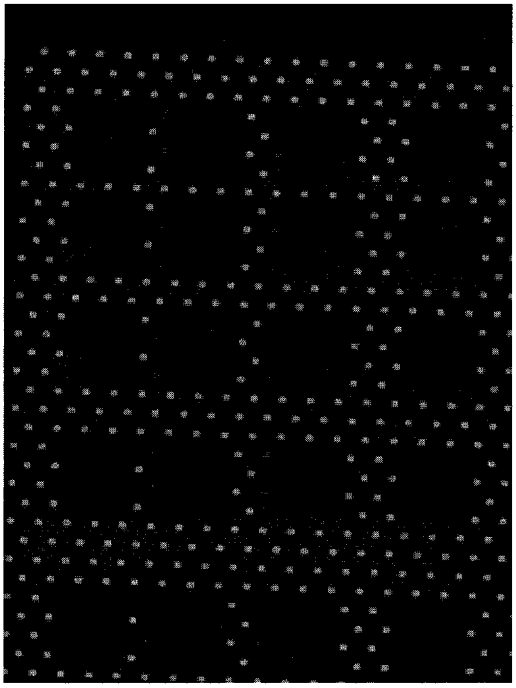
FIG. 12 is a local first pixel effect diagram of displaying the image of FIG. 10 according to the display method of the second embodiment of the present disclosure.
Figure 13:
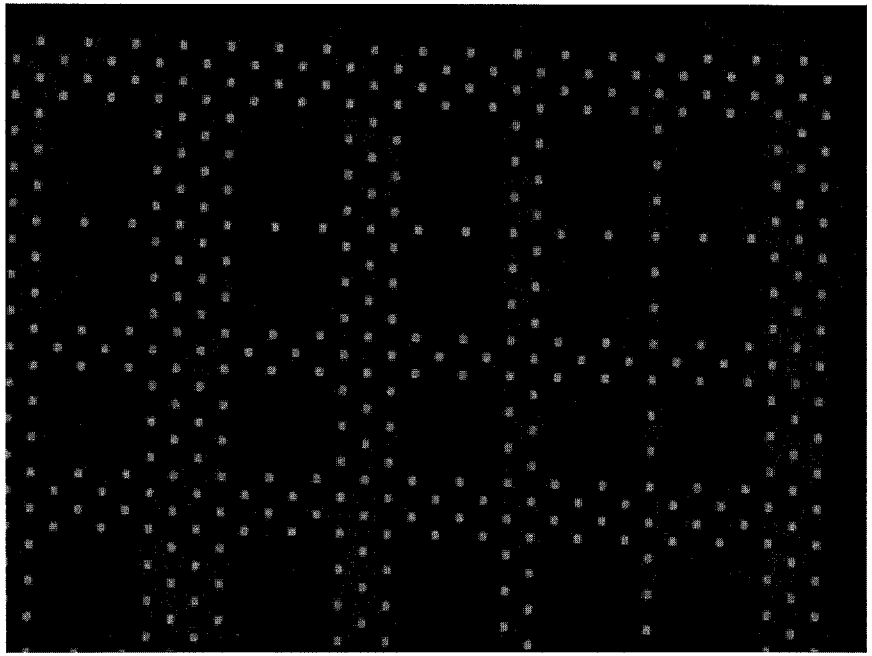
FIG. 13 is a local first pixel effect diagram of displaying the image of FIG. 10 according to the display method of the second embodiment of the present disclosure.

As shown in FIGS. 11-13, there are three different display manners for the longitudinal lines with one pixel width when using the display method of the second embodiment of the present disclosure. Because the horizontal pixel cycle of the pixel array shown in FIG. 9 is three columns, it may display three different kinds of longitudinal lines. Taking the red sub-pixel as an example, three different kinds of longitudinal lines are shown in FIGS. 14-16 respectively.

Figure 14:
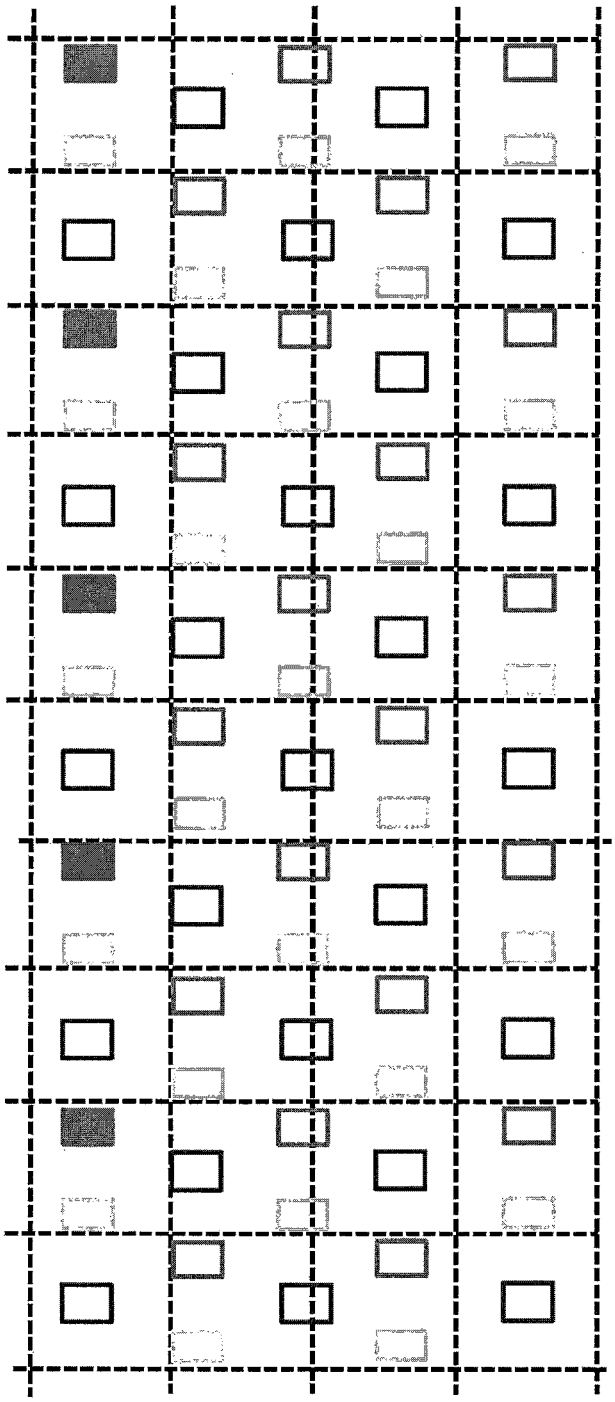
FIG. 14 is a first pixel schematic diagram of displaying a red vertical line according to the display method of the second embodiment of the present disclosure.

As shown in FIG. 14, when displaying the first kind of longitudinal line, it is displayed by only one red sub-pixel column, red sub-pixels are lit every other pixel line, and it is displayed in one-hundred percent of gray value of the red color needed to be displayed.

Figure 15:
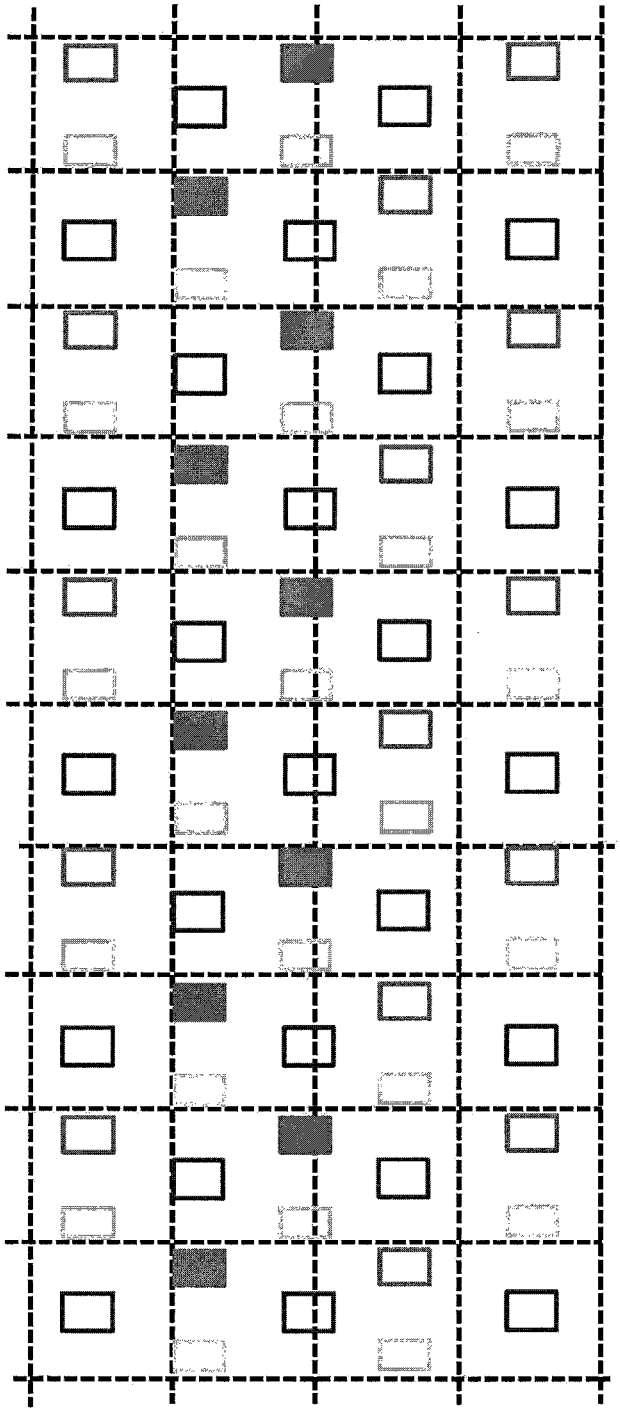
FIG. 15 is a second pixel schematic diagram of displaying a red vertical line according to the display method of the second embodiment of the present disclosure.

As shown in FIG. 15, when displaying the second kind of longitudinal line, it is displayed by two red sub-pixel columns respectively, in which one column of red sub-pixels are displayed in one-hundred percent of gray value of the red color needed to be displayed, and according to the display method of the second embodiment, the other column of red sub-pixels (the third column from left in the figure) are displayed in seventy percent of gray value of the red color needed to be displayed, i.e., the gray value actually displayed is 0.7 times of the gray value of red color in the original image.

Figure 16:
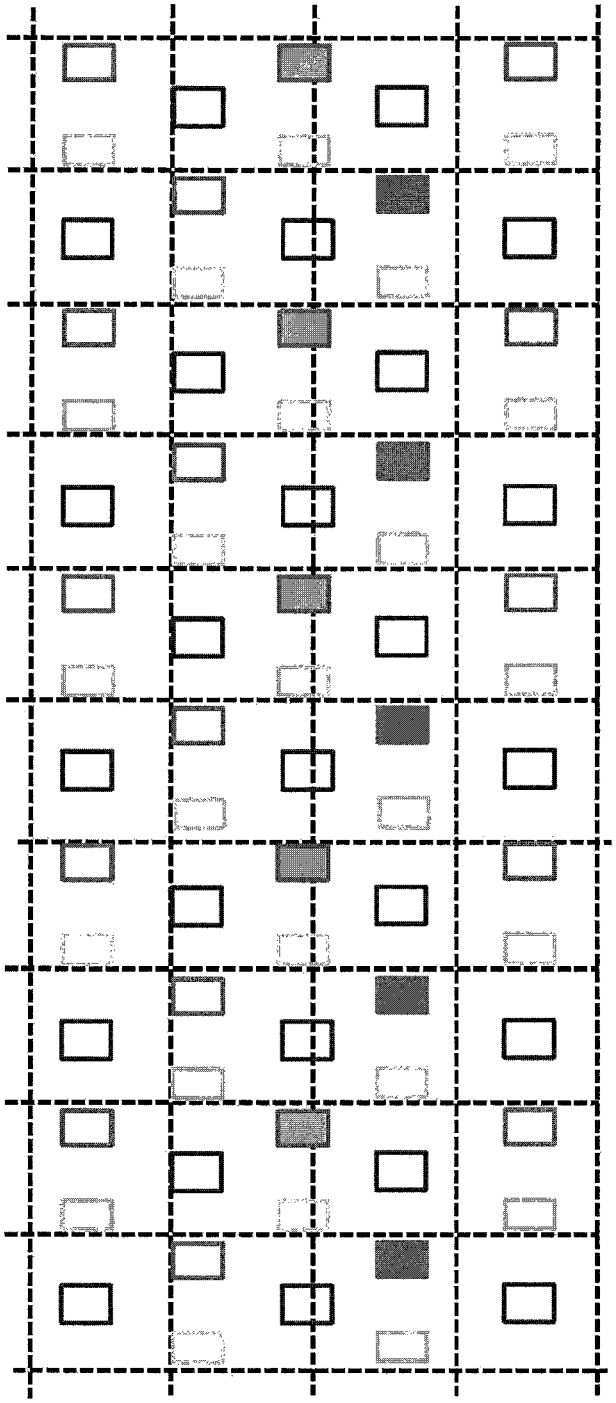
FIG. 16 is a third pixel schematic diagram of displaying a red vertical line according to the display method of the second embodiment of the present disclosure.

As shown in FIG. 16, when displaying the third kind of longitudinal line, it is displayed by two red sub-pixel columns respectively, in which one column of red sub-pixels are displayed in one-hundred percent of gray value of the red color needed to be displayed, and according to the display method of the second embodiment, the other column of red sub-pixels (the third column from left in the figure) are displayed in thirty percent of gray value of the red color needed to be displayed, i.e., the gray value actually displayed is 0.3 times of the gray value of red color in the original image.

There are only two different display manners when displaying horizontal line with one pixel width, although the two display manners both display in the same sub-pixel line. However, when displaying the horizontal line with other widths, the number of lines of sub-pixels actually emitting light equals to the number of pixels included in the width direction of the horizontal line. For example, when the horizontal line with width of four pixels is displayed, the sub-pixels actually emitting light are in four lines. While when the longitudinal line is displayed, in most cases, the number of lines of sub-pixels actually emitting light does not equal to the number of pixels included in the width direction of the longitudinal line.

The examples of displaying lines according to the display method of the second embodiment of the present disclosure are described above, and the example of displaying arrows according to the display method of the first embodiment of the present disclosure is introduced hereinafter.

Figure 17:
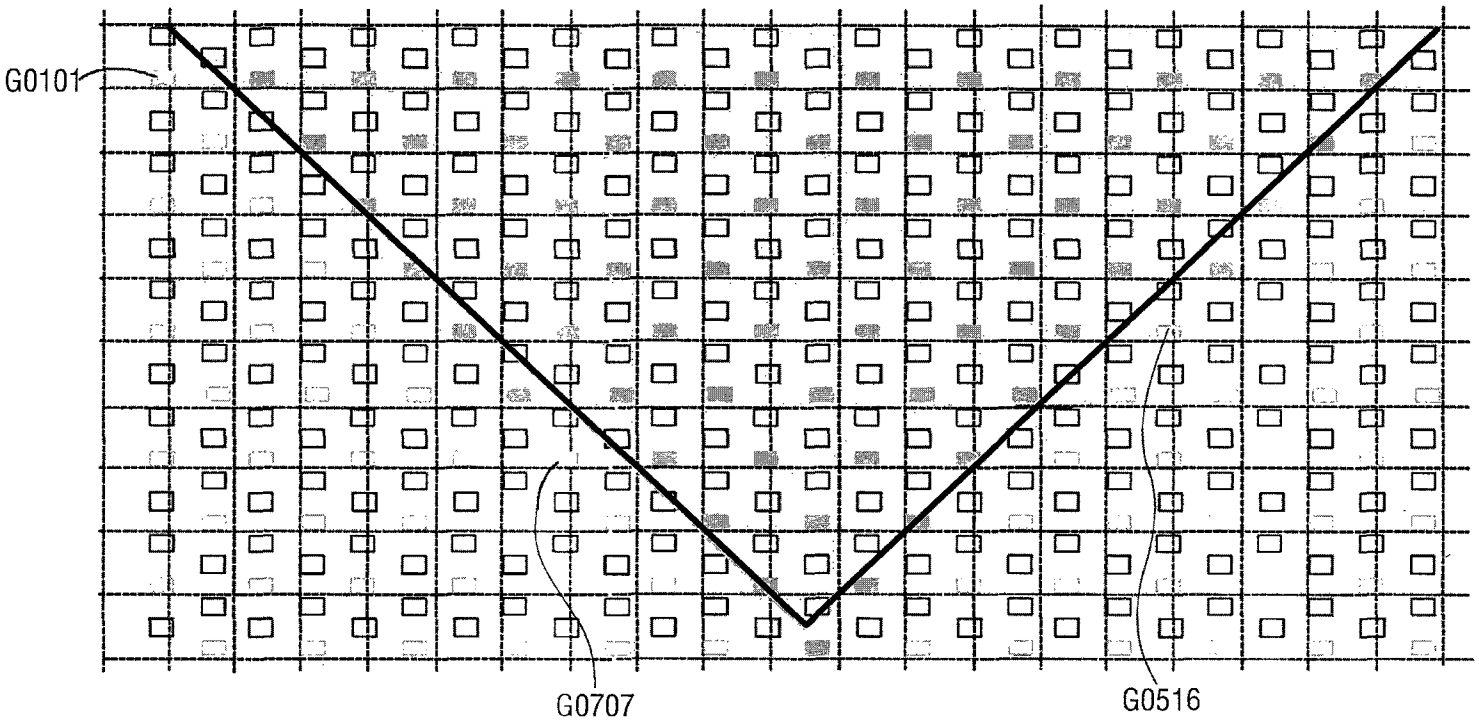
FIG. 17 is a pixel schematic diagram of displaying an arrow according to the display method of the first embodiment of the present disclosure.

As shown in FIG. 17, for the pixel array as shown in FIG. 9, when the display method of the first embodiment of the present disclosure is applied to display a green arrow, most of the green sub-pixels in the region covered by the arrow are displayed in one-hundred percent of gray value of the green color needed to be displayed. Only in the case of several boundaries, a few green sub-pixels are displayed in fifty percent of gray value of the green color needed to be displayed, which include the green sub-pixel G0101 in the pixel of the first line and first column, the green sub-pixel G0707 in the pixel of the seventh line and seventh column, and the green sub-pixel G0516 in the pixel of the fifth line and sixteenth column.

Figure 18:
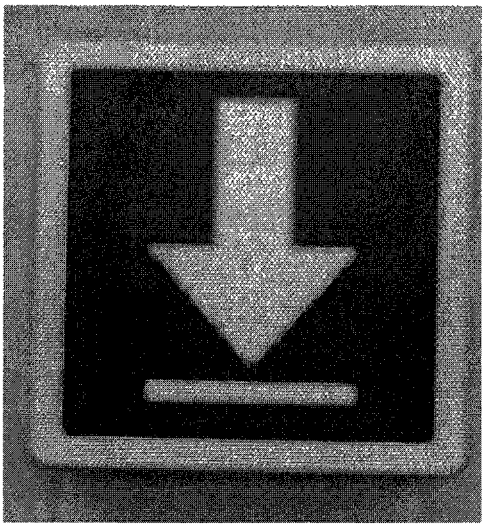
FIG. 18 is a display effect diagram of displaying an arrow according to the display method of the first embodiment of the present disclosure.
Figure 19:
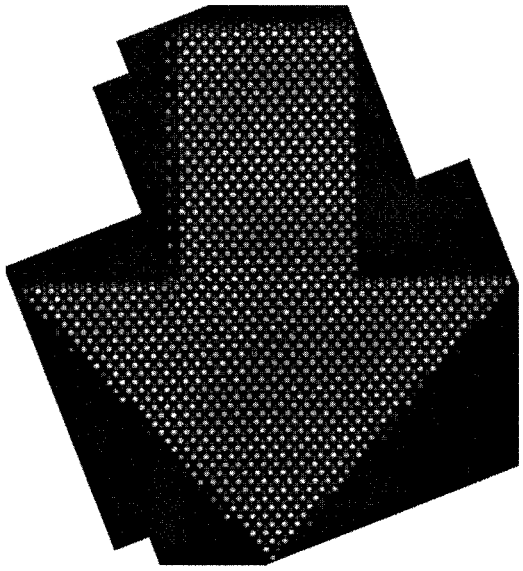
FIG. 19 is a pixel effect diagram of displaying an arrow according to the display method of the first embodiment of the present disclosure.
Figure 20:
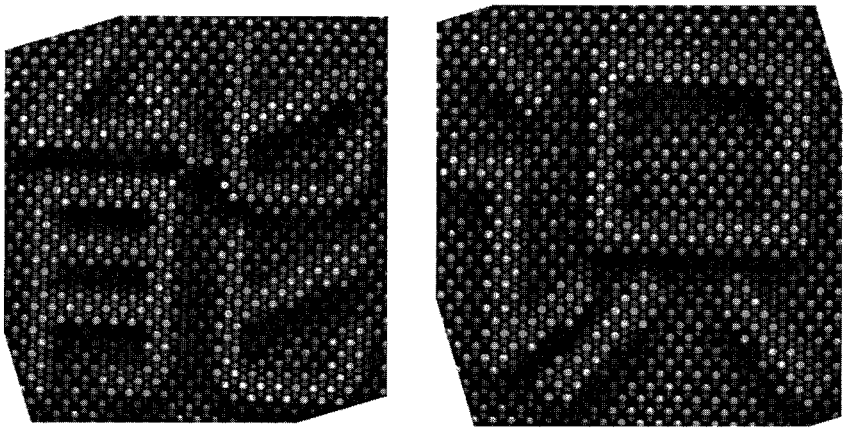
FIG. 20 is a display effect schematic diagram of displaying a word according to the display method of the first embodiment of the present disclosure.
Figure 21:
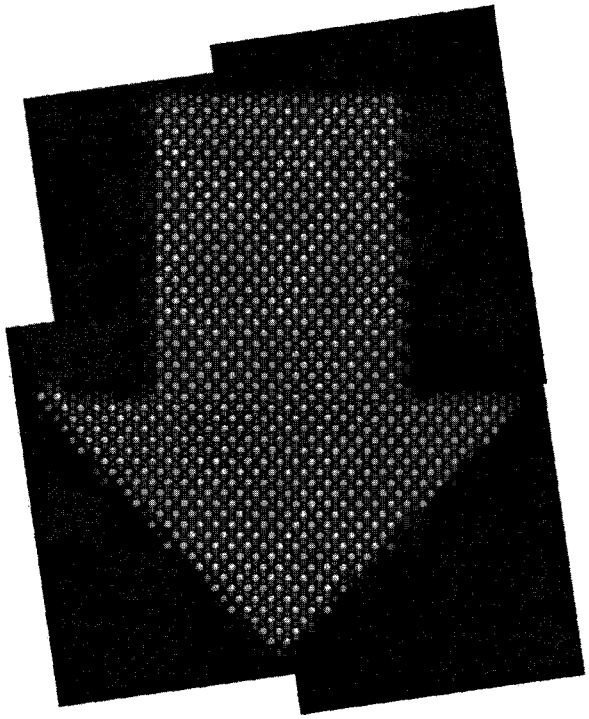
FIG. 21 is a pixel effect diagram of displaying a white arrow according to the display method of the first embodiment of the present disclosure.

Further, FIG. 18 is a display effect diagram of displaying an arrow according to the display method of the first embodiment of the present disclosure. FIG. 19 is a pixel effect diagram of displaying an arrow according to the display method of the first embodiment of the present disclosure. FIG. 20 is a display effect schematic diagram of displaying a word according to the display method of the first embodiment of the present disclosure. FIG. 21 is a pixel effect diagram of displaying a white arrow according to the display method of the first embodiment of the present disclosure. The technical effect of the display method of the present disclosure with respect to the display method of the prior art can be known by comparing FIGS. 18-21 with FIGS. 2, 3, 5 and 6 respectively. Therefore, by applying the display methods of the present disclosure, a suitable display method may be selected from the two embodiments respectively directing at different situations of display apparatus's displaying (for example, an application mainly displayed in words, and an application mainly displayed in images), thus obtaining satisfactory display effects.

The display apparatus according to embodiments of the present disclosure includes: a substrate, an organic light emitting diode and a driver. The substrate has a pixel region and a non-pixel region; the organic light emitting diode is located in the pixel region and includes a first electrode, an organic thin layer and a second electrode; the driver is used to drive the organic light emitting diode. The pixel array in the pixel region of the display apparatus according to embodiments of the present disclosure may be a pixel array as shown in FIG. 8, but not limited thereto.

The driver is used to drive the organic light emitting diode, and the driver includes an input unit, a sub-pixel display unit and an output unit. The image display methods of the above embodiments of the present disclosure are implemented in the sub-pixel display unit.

The input unit is used for inputting an image signal that denotes an image to be presented on the display apparatus. The sub-pixel color rendering unit is used for acquiring the image data denoting positions and gray values needed to be displayed of each color in the image respectively; further acquiring the proportion matrix denoting the space proportions of each color occupied in each pixel of the pixel array respectively; for each of the sub-pixels contained in each of the pixels, acquiring the sub-pixel display data according to the image data and the proportion matrix, the sub-pixel display data denoting the display gray value of each of the sub-pixels of the pixel in the pixel array. The output unit is used for generating a plurality of electrical signals according to the sub-pixel display data, and outputting the plurality of signals to the display apparatus to display the image.

Those skilled in the art shall appreciate that, modifications and variations without departing from the spirit and scope of the present disclosure as disclosed by the appended claims shall fall within the protection scope of claims of the present disclosure.

What is claimed is:

1. An image display method of a display apparatus, the display apparatus comprises a pixel array which is composed of a plurality of basic pixel units repeated along horizontal and vertical directions, and the pixel array has sub-pixels located within pixel spaces of at least two different pixels; the pixel array comprises first sub-pixels of a first color, second sub-pixels of a second color and third sub-pixels of a third color; the display method comprises:

acquiring first data denoting positions and gray values needed to be displayed of each of the first, second and third colors in the image respectively;

acquiring second data denoting space proportions of each of the first, second and third colors occupied in each pixel of the pixel array respectively; and for each of the sub-pixels contained in each of the pixels, acquiring third data according to the first data and the second data to display the image, the third data denoting a display gray value of each of the sub-pixels of the pixels in the pixel array;

wherein, the second data is a proportion matrix; for each of the basic pixel units, step of determining the second data corresponding to each of the basic pixel units is to determine a proportion vector for each pixel of the basic pixel unit firstly, and to determine the proportion matrix according to the proportion vector; and the proportion vector of the pixel has three components denoting proportion coefficients of the first sub-pixel, second sub-pixel and third sub-pixel in the pixel respectively, and the method further comprises: taking the component in the same position of each of the proportion vectors to acquire the proportion matrix.

2. The image display method according to claim 1, wherein, the first color, second color and third color are red, blue, green respectively;

the pixel array is arranged in delta pixel arrangement; and each of the basic pixel units comprises six pixels in two lines and three columns, and has four sub-pixel columns.

3. The image display method according to claim 2, wherein, each of the basic pixel units comprises: a first pixel, a second pixel and a third pixel arranged from left to right in a first line, and a fourth pixel, a fifth pixel and a sixth pixel arranged from left to right in a second line; wherein, the second pixel to the fifth pixel are composed of sub-pixels with different colors located in two adjacent horizontal lines respectively, the first pixel and the sixth pixel are composed of sub-pixels with different colors located in the same column but separated by one horizontal line respectively.

4. The image display method according to claim 1, wherein, after acquiring the proportion matrix, the method further comprises: for each sub-pixel in the basic pixel unit, multiplying the gray value needed to be displayed of the pixel to which the sub-pixel belongs by the corresponding matrix element value in the proportion matrix respectively, to obtain the display gray value of the sub-pixel in the pixel array.

5. The image display method according to claim 1, wherein, if a sub-pixel of a color of the first, second and third colors is entirely located within the pixel space of one pixel, then the proportion coefficient of the sub-pixel of the color in the pixel is set to be 1; if a sub-pixel of the color is completely not located within the pixel space of the pixel, then the proportion coefficient of the sub-pixel of the color in the pixel is set to be 0.

6. The image display method according to claim 5, wherein, if most part of a sub-pixel of the color is located within the pixel space of the pixel, then the proportion coefficient of the sub-pixel of the color in the pixel is a first proportion coefficient larger than 0.5; if a small part of a sub-pixel of the color is located within the pixel space of the pixel, then the proportion coefficient of the sub-pixel of the color in the pixel is a second proportion coefficient smaller than 0.5; a sum of the first proportion coefficient and the second proportion coefficient is 1.

7. The image display method according to claim 6, wherein, the first proportion coefficient is set to be 0.7.

8. The image display method according to claim 1, wherein, if a sub-pixel of a color of the first, second and third colors is partially located within the pixel space of one pixel, then the proportion coefficient of the sub-pixel of the color in the pixel is set to be 0.5.

9. A display apparatus, comprising:

a substrate, having a pixel region and a non-pixel region, wherein, a pixel array of the pixel region is composed of a plurality of basic pixel units repeated along horizontal and vertical directions, and the pixel array has sub-pixels located within pixel spaces of at least two different pixels; the pixel array comprises first sub-pixels of a first color, second sub-pixels of a second color and third sub-pixels of a third color;

an organic light emitting diode, located in the pixel region of the substrate and comprising a first electrode, an organic layer and a second electrode; and a driver circuit, electrically connected to the organic light emitting diode for driving the organic light emitting diode, the driver circuit being configured to:

receive an image signal to denote an image to be displayed on the display apparatus;

acquire first data denoting positions and gray values needed to be displayed of each of the first, second and third colors in the image received, respectively; and to acquire second data denoting space proportions of each of the first, second and third colors occupied in each pixel of the pixel array respectively; for each of the sub-pixels contained in each of the pixels, acquire third data according to the first data and the second data, the third data denoting a display gray value of each of the sub-pixels of the pixel in the pixel array; and generate a plurality of signals according to the third data, which denote the display gray value of each of the sub-pixels of the pixel in the pixel array, and output the plurality of signals to the display apparatus;

wherein, the second data is a proportion matrix; for each of the basic pixel units, when determining the second data corresponding to the basic pixel unit, a proportion vector is determined for each pixel of the basic pixel unit firstly, and the proportion matrix is determined according to the proportion vector; and the proportion vector of the pixel has three components denoting proportion coefficients of the first sub-pixel, second sub-pixel and third sub-pixel in the pixel respectively, and the proportion matrix is acquired by taking the component in the same position of each of the proportion vectors.

10. The display apparatus according to claim 9, wherein, the first color, second color and third color are red, blue and green, respectively;

the pixel array is arranged in delta pixel arrangement; and each of the basic pixel units comprises six pixels in two lines and three columns, and has four sub-pixel columns.

11. The display apparatus according to claim 10, wherein, each of the basic pixel units comprises: a first pixel, a second pixel and a third pixel arranged from left to right in a first line, and a fourth pixel, a fifth pixel and a sixth pixel arranged from left to right in a second line; wherein, the second pixel to the fifth pixel are composed of sub-pixels with different colors located in two adjacent horizontal lines respectively, the first pixel and the sixth pixel are composed of sub-pixels with different colors located in the same column but separated by one horizontal line respectively.

12. The display apparatus according to claim 9, wherein, after the proportion matrix is acquired, for each sub-pixel in the basic pixel unit, the gray value needed to be displayed of the pixel to which the sub-pixel belongs is multiplied by the corresponding matrix element value in the proportion matrix respectively, to obtain the display gray value of the sub-pixel in the pixel array.

13. The display apparatus according to claim 9, wherein, if a sub-pixel of a color of the first, second and third colors is entirely located within the pixel space of one pixel, then the proportion coefficient of the sub-pixel of the color in the pixel is set to be 1; if a sub-pixel of the color is completely not located within the pixel space of the pixel, then the proportion coefficient of the sub-pixel of the color in the pixel is set to be 0.

14. The display apparatus according to claim 13, wherein, if most part of a sub-pixel of the color is located within the pixel space of the pixel, then the proportion coefficient of the sub-pixel of the color in the pixel is a first proportion coefficient larger than 0.5; if a small part of a sub-pixel of the color is located within the pixel space of the pixel, then the proportion coefficient of the sub-pixel of the color in the pixel is a second proportion coefficient smaller than 0.5; a sum of the first proportion coefficient and the second proportion coefficient is 1.

15. The display apparatus according to claim 14, wherein, the first proportion coefficient is set to be 0.7.

16. The display apparatus according to claim 9, wherein, if a sub-pixel of a color is partially located within the pixel space of one pixel, then the proportion coefficient of the sub-pixel of the color in the pixel is set to be 0.5.

* * * * *